US008485162B2

(12) United States Patent
Ikeda

(10) Patent No.: US 8,485,162 B2
(45) Date of Patent: Jul. 16, 2013

(54) PLASMA APPARATUS USING A VALVE

(75) Inventor: Yuji Ikeda, Kobe (JP)

(73) Assignee: Imagineering, Inc., Kobe-shi, Hyogo (JP)

( * ) Notice: Subject to any disclaimer, the term of this patent is extended or adjusted under 35 U.S.C. 154(b) by 351 days.

(21) Appl. No.: 12/881,828

(22) Filed: Sep. 14, 2010

(65) Prior Publication Data

US 2011/0031886 A1 Feb. 10, 2011

Related U.S. Application Data

(63) Continuation-in-part of application No. PCT/JP2009/054963, filed on Mar. 13, 2009.

(30) Foreign Application Priority Data

Mar. 14, 2008 (JP) ..... 2008-066887

(51) Int. Cl.
*F02P 23/04* (2006.01)

(52) U.S. Cl.
USPC ..... 123/536

(58) Field of Classification Search
USPC ..... 123/536–539, 143 R, 143 B, 169 EL
See application file for complete search history.

(56) References Cited

U.S. PATENT DOCUMENTS

| | | | | |
|---|---|---|---|---|
| 3,934,566 | A * | 1/1976 | Ward | 123/275 |
| 4,672,938 | A * | 6/1987 | Hoppie et al. | 123/538 |
| 5,027,764 | A * | 7/1991 | Reimann | 123/143 B |
| 7,793,632 | B2 * | 9/2010 | Idogawa et al. | 123/169 R |
| 8,156,911 | B2 * | 4/2012 | Ikeda | 123/143 B |
| 2007/0266979 | A1 | 11/2007 | Nagamine et al. | |
| 2009/0229581 | A1 * | 9/2009 | Ikeda | 123/536 |
| 2010/0180871 | A1 | 7/2010 | Ikeda et al. | |
| 2011/0030347 | A1 * | 2/2011 | Ikeda | 60/275 |

FOREIGN PATENT DOCUMENTS

| | | | |
|---|---|---|---|
| JP | 56-067373 | U | 6/1981 |
| JP | 57-203870 | A | 12/1982 |
| JP | 59-215967 | A | 12/1984 |
| JP | 2000-179412 | A | 6/2000 |
| JP | 2002-295259 | A | 10/2002 |
| JP | 2002-295264 | A | 10/2002 |
| JP | 2007-113570 | A | 5/2007 |
| JP | 2007-309160 | A | 11/2007 |
| WO | 2009/008523 | A1 | 1/2009 |

OTHER PUBLICATIONS

International Search Report of PCT/JP2009/054963, mailing date Apr. 7, 2009.

* cited by examiner

*Primary Examiner* — M. McMahon
(74) *Attorney, Agent, or Firm* — Westerman, Hattori, Daniels & Adrian, LLP

(57) ABSTRACT

Provided is a plasma apparatus using a valve, which comprises a discharge device with an electrode exposed to the combustion chamber installed in a cylinder head, an antenna installed on the valve face of a valve head, an electromagnetic wave transmission line installed in a valve stem with one end connected to the antenna and the other end covered with an insulator or dielectric and extending to a power-receiving portion positioned at a location fitting into the guide hole in the valve stem, and an electromagnetic wave generator for feeding an electromagnetic waves to the power-receiving portion. At the compression stroke when the combustion chamber side opening of an intake port or an exhaust port is closed with the valve head, discharge is generated with the electrode of the discharge device and the electromagnetic waves fed from the electromagnetic wave generator through the electromagnetic wave transmission line are radiated from the antenna.

11 Claims, 5 Drawing Sheets

PLASMA APPARATUS USING A VALVE

TECHNICAL FIELD

The present invention belongs to the field of the internal combustion engine and relates to the improvement of combustion in the combustion chamber of an internal combustion engine in which a combustion chamber side opening of an intake port or an exhaust port is opened and closed at a given timing with an intake valve or an exhaust valve.

BACKGROUND OF THE INVENTION

Patent Document 1 shows an internal combustion engine including a combustion/reaction chamber, auto-ignition means, microwave radiation means, and control means. The combustion/reaction chamber consists of a cylinder and piston. The combustion/reaction chamber is supplied with a mixture of reactive and oxidation gas. In the combustion/reaction chamber, a plasma reaction of the mixture is carried out. The auto-ignition means automatically ignites the mixture by injecting a mixture of reactive and oxidation gas under high pressure, compressing the mixture and increasing the temperature. The microwave radiation means radiates the combustion/reaction chamber with microwaves. The control means controls the auto-ignition means and microwave radiation means, and repeats a cycle that involves radiating the combustion/reaction chamber with microwaves so that large amounts of hydroxyl (OH) radicals and ozone ($O_3$) are generated from the moisture in the combustion/reaction chamber mixture, which then oxidizes and reacts chemically, combustion of the mixture in the combustion/reaction chamber is promoted by the large amount of OH radicals and $O_3$, when the auto-ignition, means ignites the mixture.

The internal-combustion engine with an electrical field formed in the combustion chamber is disclosed in Patent Documents 2 to 4. Patent Document 2 outlines an internal combustion engine, containing the following: a cylinder block with a cylinder wall; a cylinder head on the cylinder block; a piston in the cylinder block; a combustion chamber formed by the cylinder wall, cylinder head and piston; and an electrical field apply means for applying an electrical field in the combustion chamber during combustion of the engine. When an electrical field is applied to the flame in this internal combustion engine, ions move into the flame and collide. This increases the flame propagation speed, and the ions in the gas that has already burnt move to unburned gas and alter the chemical reaction in the unburned gas. This maintains a uniform flame temperature and controls engine knock.

[Patent Document 1] Japanese Patent Application Laid-open Publication No. 2007-113570

[Patent Document 2] Japanese Patent Application Laid-open Publication No. 2000-179412

[Patent Document 3] Japanese Patent Application Laid-open Publication No. 2002-295259

[Patent Document 4] Japanese Patent Application Laid-open Publication No. 2002-295264

SUMMARY OF THE INVENTION

The inventor of the present invention extrapolated the mechanism of combustion promotion in the internal combustion engine which is disclosed in Patent Document 1, and obtained a constant finding about the mechanism. In this mechanism, a small amount of plasma is discharged firstly. The plasma is irradiated with microwaves for a given period of time, so that the amount of plasma increases. Thus a large amount of OH radicals and ozone is generated from moisture in the air-fuel mixture within a short period of time, promoting an air-fuel mixture reaction. This mechanism of the combustion promotion, obtained by generating a large amount of OH radicals and ozone, promotes combustion with plasma, is entirely different from combustion-promoting mechanisms that use ions to increase flame propagation speed, disclosed in Patent Documents 2 through 4.

In the art of Patent Documents 2, said electrical field apply means comprises a conductive member arranged so as to apply the electrical field in the combustion chamber. This conductive member is a nickel-chromium alloy wire, with a preferable diameter of 1.0 mm, and installed in an annular groove established in an annular insulator inserted in the cylinder wall of the cylinder block. In the art of Patent Documents 2 through 4, the substantial modifications required for the cylinder block and other structural components of a conventional internal combustion engine. These modifications increase the time required to design an engine, and do not permit the sharing of parts with existing internal combustion engines.

In the view of the foregoing, the present invention has been achieved. An object of the invention is to provide a plasma apparatus using a valve, which can easily realize the combustion-promoting mechanism, obtained by generating a large amount of OH radicals and ozone with plasma, by using the existing internal combustion engine as far as possible. By this realization, it can be realized to minimize the time required to design an engine and facilitate the sharing of many parts between existing internal combustion engines.

The present invention is plasma apparatus using a valve, which is installed in an internal combustion engine in which the combustion chamber side opening of a intake port or an exhaust port is opened and closed at a given timing with a valve head at the end of a valve stem of a intake valve or an exhaust valve, the intake port or the exhaust port is formed in a cylinder head and connects to the combustion chamber to be part of the exhaust passage, the valve stem fits into a guide hole penetrating from the intake port or the exhaust port to the outer wall of the cylinder head and reciprocating freely, the plasma apparatus using a valve comprises, a discharge device with an electrode exposed to the combustion chamber installed in the cylinder head, an antenna installed on the valve face of the valve head, an electromagnetic wave transmission line installed in the valve stem with one end connected to the antenna and the other end, covered with an insulator or dielectric and extending to a power-receiving portion, which is positioned at a location fitting into the guide hole or at a location farther from the valve head in the valve stem, and an electromagnetic wave generator for feeding electromagnetic waves to the power-receiving portion, wherein the plasma apparatus is configured such that discharge is generated with the electrode of the discharge device and the electromagnetic waves fed from the electromagnetic wave generator through the electromagnetic wave transmission line are radiated from the antenna at the compression stroke when the combustion chamber side opening of the intake port or the exhaust port is closed with the valve head.

At the compression stroke in the actuation of the internal combustion engine, discharge is generated at the electrode of the discharge device and the electromagnetic waves fed from the electromagnetic wave generator through the electromagnetic wave transmission line are radiated from the antenna. Therefore, the plasma is generated near the electrode. This plasma receives energy of an electromagnetic waves (electromagnetic wave pulse) supplied from the antenna for a given period of time. As a result, the plasma generates a large amount of OH radicals and ozone to promote the combustion. In fact electrons near the electrode are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the combustion of the mixture.

In this case, the cylinder block etc. which are the major structural materials can be used without modification compared with existing internal combustion engine. And the intake valve, exhaust valve, and the structure around these valves are remodeled. With the exception of internal combustion engine which basically needs spark plug, it may mount a discharge device on the cylinder head in internal combustion engine that is not necessary a spark plug. Therefore, it is realized to minimize the time required to design an internal combustion engine and share many parts with existing internal combustion engines.

The plasma apparatus using a valve of the present invention may be applicable for which the antenna forms nearly a C shape to surround the center on the valve face and one end of the antenna is connected to the electromagnetic wave transmission line.

This makes the antenna compact on the back face.

The plasma apparatus of the present invention may be applicable for which the power-receiving portion exposed on the outer wall of valve stem, and the plasma apparatus includes, a dielectric member installed in the cylinder head and near the power-receiving portion, at least when the valve head closes the combustion chamber side opening of the intake port or the exhaust port, made from dielectric material, and a power-feeding member made from conductive material, which is installed in the cylinder head close to the dielectric member opposite the valve stem, wherein plasma apparatus is configured such that the power-feeding member would be fed the electromagnetic waves from the electromagnetic wave generator.

This makes it possible to have non-contact electromagnetic wave transmission from the electromagnetic wave generator to the electromagnetic wave transmission line through the power-feeding member, the dielectric member, and the power-receiving portion.

The plasma apparatus of the present invention may be applicable for which a valve guide mounted hole, which penetrates from the intake port or the exhaust port to the outer wall of cylinder head, is installed in the cylinder head, a valve guide with trunk shape made from dielectric material fits into the valve guide mounted hole allowing a hole in the valve guide to serve as a guide hole, and a portion of the valve guide, approaching the power-receiving portion at least when the valve head closes the combustion chamber side opening of the intake port or the exhaust port, is the dielectric member.

This makes it possible to have non-contact electromagnetic wave transmission from the electromagnetic wave generator to the electromagnetic wave transmission line by using heretofore known mechanism for mounting the valve guide.

The plasma apparatus using a valve of the present invention may be applicable for which the electrode is located close to a portion where the electric field intensity generated by the electromagnetic waves around the valve face of the valve head becomes strong when the electromagnetic waves are fed to the antenna.

This makes it possible that the electromagnetic wave pulse irradiates the plasma generated by the discharge at the electrode from the antenna near plasma. The energy is intensively supplied to said plasma. As a result, a large amount of OH radicals and ozone is efficiently generated, further promoting the combustion.

DESCRIPTION OF REFERENCE CHARACTERS

Figure 1:
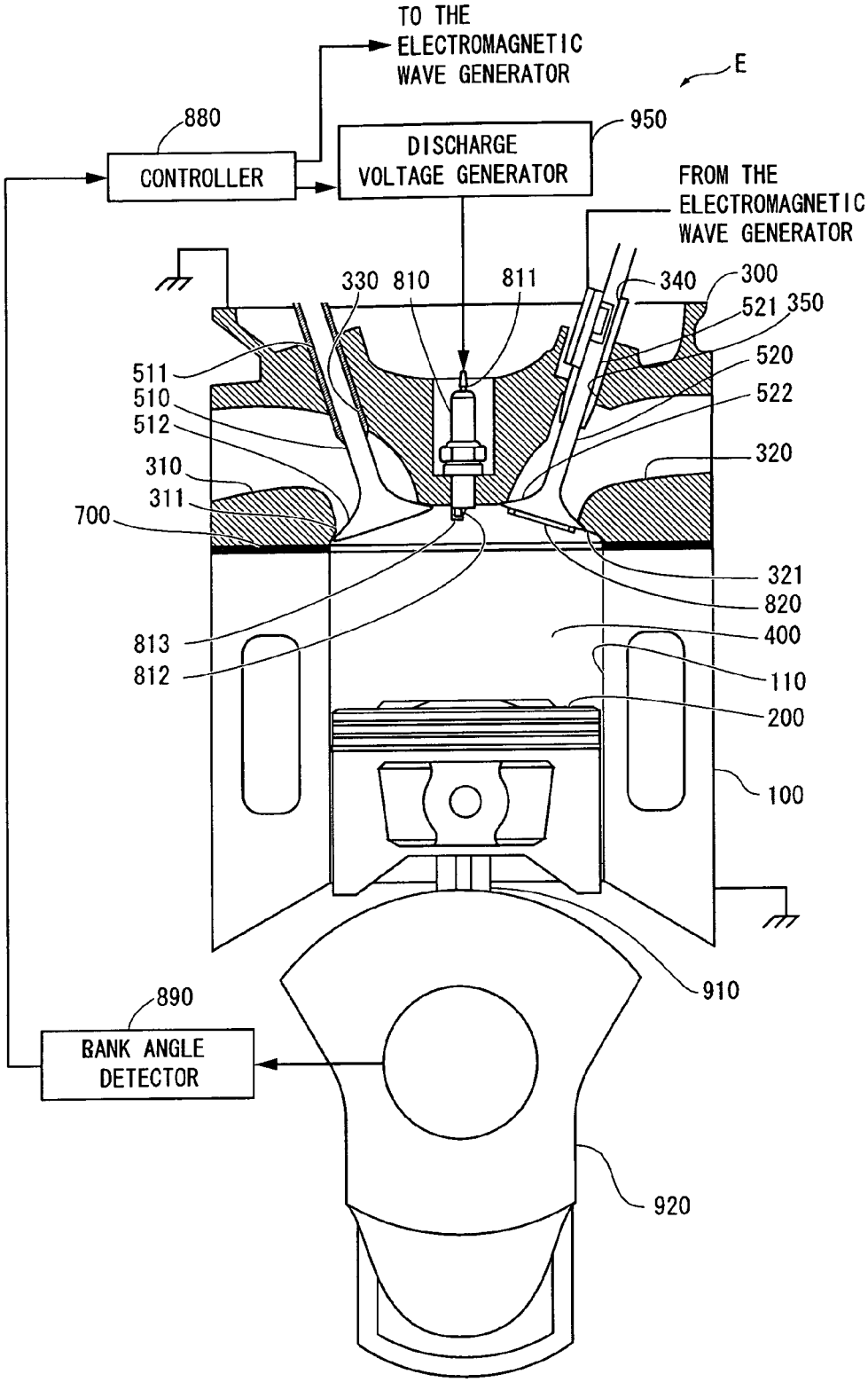
FIG. 1 shows a vertical cross-sectional view of combustion chamber in an internal combustion engine with the plasma apparatus using a valve in the first embodiment of the present invention.

E Internal combustion engine
100 Cylinder block
110 Cylinder
200 Piston
300 Cylinder head
310 Intake port
311 Opening
330 Guide hole
320 Exhaust port
321 Opening
340 Guide hole
350 Valve guide mounted hole
360 Valve guide
400 Combustion chamber
510 Intake valve
511 Valve stem
512 Valve head
520 Exhaust valve
521 Valve stem
521*a* Basic portion
521*b* Periphery portion
522 Valve head
522*a* Basic portion
522*b* Valve face
810 Discharge device
812 First electrode
813 Second electrode
820 Antenna

830 Electromagnetic wave transmission line
840 Electromagnetic wave generator
850 Dielectric member
860 Power-feeding member

DETAILED DESCRIPTION OF THE INVENTION

Hereinafter, embodiments of the present invention will be described. FIG. 1 shows the embodiments of the internal combustion engine E comprising the plasma apparatus using a valve of the present invention. The present invention targets reciprocating engines. In this embodiment, engine E is a four-cycle gasoline engine. Cylinder block 100 contains cylinder 110, which has an approximately circular cross section. Cylinder 110 penetrates cylinder block 100. Piston 200, which has an approximately circular cross section corresponding to cylinder 110, fits into cylinder 110 and reciprocates freely. Cylinder head 300 is assembled on the anti-crankcase side of cylinder block 110. Cylinder head 300, piston 200, and cylinder 110 form combustion chamber 400. Item 910 is a connecting rod, with one end connected to piston 200 and the other end connected to crankshaft 920, which is the output shaft. Cylinder head 300 has intake port 310, which is a component of the intake line, and exhaust port 320, which is a component of the exhaust line. One end of intake port 310 connects to combustion chamber 400; the other end is open at the outside wall of cylinder head 300. One end of exhaust port 320 connects to combustion chamber 400; the other end is open at the outside wall of cylinder head 300. The cylinder head has guide hole 330 that passes through intake port 310 to the outside wall of cylinder head 300. Rod-shaped valve stem 511 of intake valve 510 fits into guiding hole 330 and reciprocates freely. Umbrella-shaped valve head 512, set at the end of valve stem 511, opens and closes the combustion chamber side opening of intake port 310 at a given timing by a valve open/close mechanism having a cam and so on (not shown in the figure). Cylinder head 300 has guiding hole 340 that passes through exhaust port 320 to the outside wall of cylinder head 300. Rod-shaped valve stem 521 of exhaust valve 520 fits into guiding hole 340 and reciprocates freely. Umbrella-shaped valve head 522, set at the end of valve stem 521, opens and closes the combustion chamber side opening 321 of the exhaust port 320 at a given time by the valve open/close mechanism having cam and so on (not shown in the figure). Item 810 is a spark plug installed in cylinder head 300 to expose a pair of electrodes 812, 813 to combustion chamber 400. Spark plug 810 discharges at the electrodes when piston 200 is near top dead center. Therefore, four strokes (intake, compression, combustion of mixture, and exhaust of exhaust gas) occur while piston 200 reciprocates between top dead center and bottom dead center twice. However, this embodiment does not restrict the interpretation of the internal combustion engine targeted by the present invention. The present invention is also suitable for use with two-stroke internal combustion engines and diesel engines. Target gasoline engines include direct-injection gasoline engines, which create a mixture inside the combustion chamber to inject fuel into the intake air. Target diesel engines include direct-injection diesel engines, which inject fuel into the combustion chamber directly, and divided-chamber diesel engines, which inject fuel into the divided chamber. Internal combustion engine E in this embodiment has four cylinders, but this does not restrict number of cylinders of the internal combustion engine targeted by the present invention. The internal combustion engine for this embodiment has two intake valves 510 and two exhaust valves 520, but this does not restrict the number of intake or exhaust valves of the internal combustion engine targeted by the present invention. Item 700 is a gasket installed between cylinder block 100 and cylinder head 300.

Said spark plug 810 also functions as a discharge device 810 of the plasma apparatus using a valve of the present invention. This discharge device 810 is installed in the cylinder head 300. This discharge device 810 is set on the wall of the combustion chamber 400. This discharge device 810 comprises a connection 811 set outside of the combustion chamber 400, a first electrode 812 electrically-connected to the connection 811, and a second electrode 813 contacts the cylinder head 300 and connects in ground. The first electrode 812 and the second electrode 813 are placed opposite at specified interval on the discharge device 810. Both of them are exposed to the combustion chamber 400. The discharge device 810 is connected to a discharge voltage generator 950 which generates voltage for discharge. Here, the discharge voltage generator 950 is DC 12V power supply and a spark coil. The cylinder head 300 is earthed and the connection 811 connects to the discharge voltage generator 950. In case of applying voltage between the cylinder head 300 and the connection 811, discharge happens between the first electrode 812 and the second electrode 813. As described above, it may discharge between electrode of the discharge device and a wall of the combustion chamber, or other earthed members without a pair of electrodes. For example, in case that the internal combustion engine is a diesel engine, it does not install a spark plug under normal circumstances. Therefore it needs to install the discharge device, having an electrode exposed to the combustion chamber, on the cylinder head. In this case, it may install the spark plug as explained above as the discharge device, and connects it to the discharge voltage generator. However the discharge device does not always need to use a spark plug, because the discharge device requires generating plasma by discharge regardless the size. The discharge device may be used for example piezo element or other device.

Figure 2:
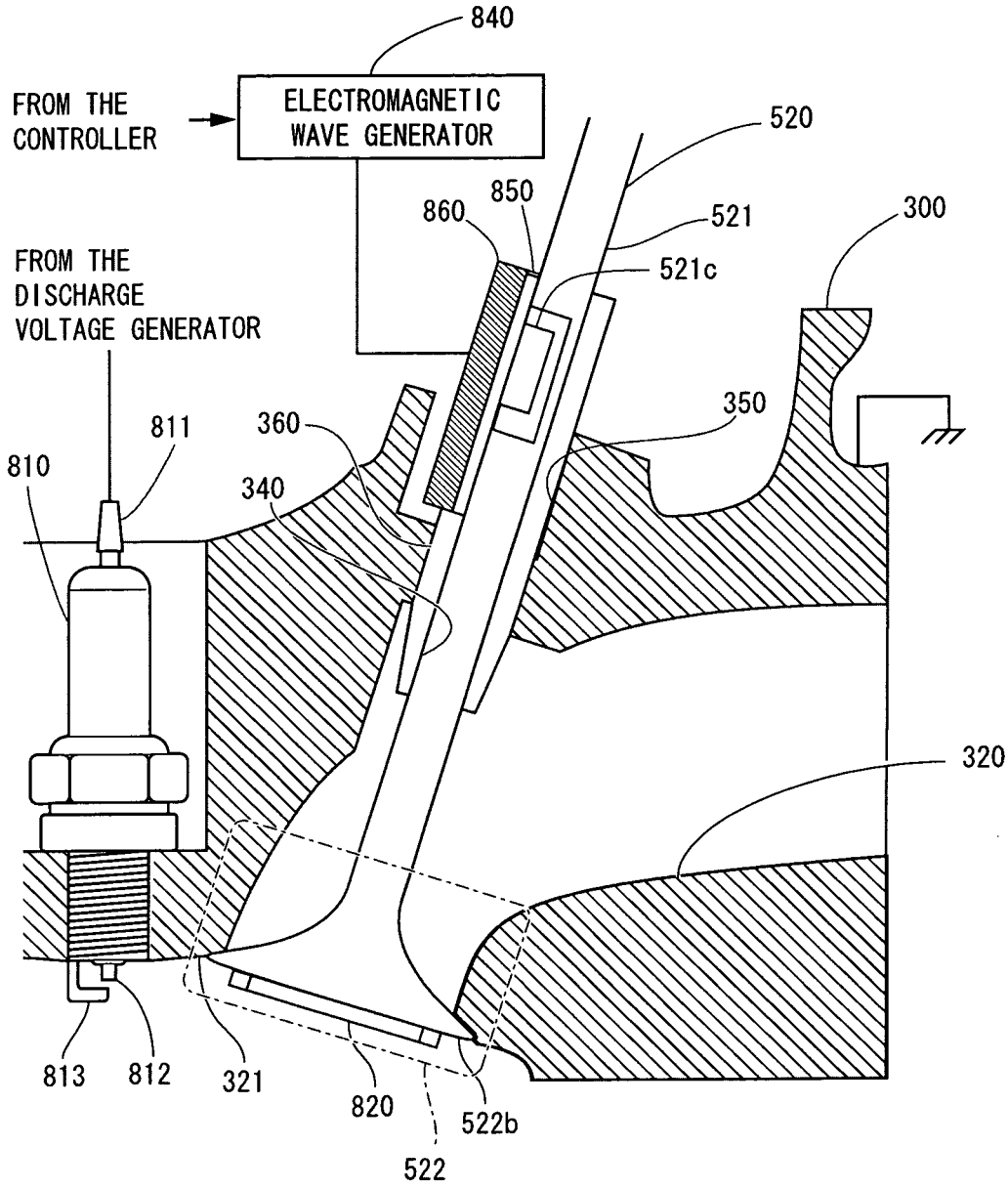
FIG. 2 shows an enlarged vertical cross-sectional view of exhaust port in an internal combustion engine with the plasma apparatus using a valve in the first embodiment of the present invention.
Figure 4:
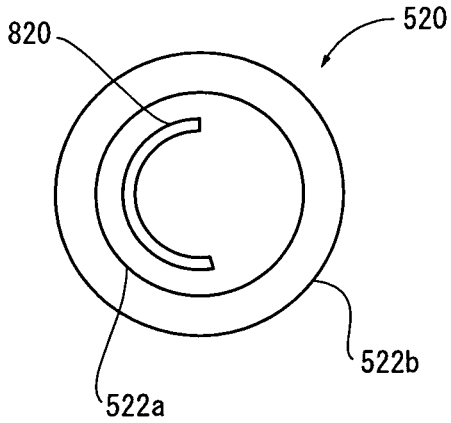
FIG. 4 shows an enlarged view of exhaust valve used in the plasma apparatus using a valve in the first embodiment of the present invention, as seen from the valve face.

An antenna 820 is installed on the valve face 522*b* of the valve head 522 of said exhaust valve 520 as shown in FIG. 2 and FIG. 4. The valve face 522*b* is a surface on opposite side against a back-face faces to the exhaust port 320 of the valve head 522. The valve face 522*b* faces the combustion chamber 400 when the combustion chamber opening 321 of the exhaust port 320 is closed with the valve head 522. The antenna 820 is made from metal. However, it can be made from a conductor, dielectric or insulator, provided that electromagnetic waves are radiated well from it to the combustion chamber when they are supplied between the antenna and the earth member. The Antenna 820 is a bar-style unit with curvature and forms nearly a C shape to surround the center of the valve face 522*b* of the valve head 522. The antenna 820 radiates electromagnetic waves to the combustion chamber 400. In fact, the antenna 820 forms nearly a C shape, in sum circularity with hiatus, to surround valve face 522*b*, as seen along the direction of valve stem 521 extending. The inside of a portion of the valve stem 521 fitting into a guide hole 340 is made from dielectric and becomes a basic portion 521*a*. A periphery side portion of this basic portion 521*a*, the portion fits into the guide hole 340, is made from metal and becomes a periphery portion 521*b*. A reason for the periphery portion 521*b* made from metal is to enhance rub resistance and burning resistance, and it can be made from other materials. Also, no fitting portions into the guide hole 340 can be made from dielectric on the valve stem 521. In addition, a successive portion to the basic portion 521*a* of said valve stem 521 is made from dielectric and becomes a basic portion 522*a* in the valve head 522. And a valve face 522*b* on the combustion chamber side of the valve head 522 is made from metal. A reason for the valve face 522*b* made from metal is to enhance burning resistance. However, it can be made from other materials. The antenna 820 is installed on the back of the basic portion 522*a* in the valve head 522. In this case, ceramic is used as dielectric. However, other dielectrics or insults can be used. For example, the length of the antenna 820 is set to a quarter of wavelength in electromagnetic waves, standing wave is generated in the antenna 820. Thus, electrical field strength at the end of antenna 820 becomes strong. For example, the length of the antenna 820 is set to a multiple of a quarter wavelengths of the electromagnetic waves so that standing waves are generated in the antenna 820, increasing the electrical field at multiple points, where the anti-nodes of the standing waves are generated, in the antenna 820. The antenna 820 can be buried in the valve head 522. In addition, the first electrode 821 and the second electrode 813 are located close to a portion that electric field intensity, generated by the electromagnetic waves around the valve face 522*b* of the valve head 522, becomes strong when the electromagnetic waves are fed to said antenna 820. In this case, the top of the antenna 820 gets close to the first current 812 and the second current 813. Therefore, upon supplying electromagnetic waves between the antenna 820 and the cylinder head 300, which is an earth member, the electromagnetic waves is radiated from the antenna 820 to the combustion chamber 400. And, one end of the antenna 820 connects to the electromagnetic wave transmission line 830, which is explained in below. In this embodiment, antenna 820 is a rod-shaped monopole antenna that is curved one. However, this does not restrict the type of antenna in the plasma apparatus of the present invention. Therefore, antenna of the plasma apparatus of the present invention may be dipole antenna, Yagi-Uda antenna, a single feed antenna, a loop antenna, a phase difference feed antenna, a ground-plane antenna, a anti-ground-plane type vertical antenna, a beam antenna, a horizontally polarized omni-directional antenna, a corner antenna, comb antenna, or one of the other linear antenna, a micro-strip antenna, a inverted-F antenna, or other plane antenna, slotted array antenna, a parabolic antenna, a horn antenna, a horn reflector antenna, a cassegrain antenna or other solid antennas, Beverage antenna or other progressive wave antennas, star type EH antennas, bridge type EH antennas or other EH antennas, a bar antenna, a minute loop antennas or one of the other magnetic field antennas or dielectric substance antennas.

Figure 3:
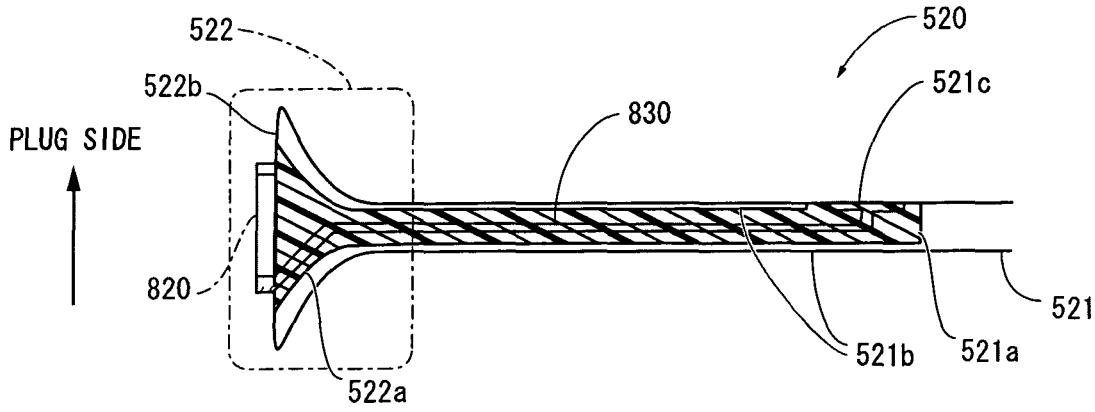
FIG. 3 shows an enlarged vertical cross-sectional view of exhaust valve used in the plasma apparatus using a valve in the first embodiment of the present invention.

Electromagnetic wave transmission line 830, made from copper line, is installed in valve stem 521 of exhaust valve 520, as shown in FIG. 3. This electromagnetic waves transmission line 780 is made from copper line. Electromagnetic wave transmission line 830 may also be made from any conductor, insulator, or dielectric, as long as electromagnetic waves are transmitted well to antenna 820 when they are supplied between antenna 820 and the earthed member. A possible variation is an electromagnetic wave transmission line that consists of a waveguide made from a conductor or dielectric. Power-receiving portion 521*c* is installed in a fitting portion into valve guide 340 of valve stem 521. Power-receiving portion 521*c* can be made from a conductor, dielectric, or insulator. Here, power-receiving portion 521*c* is located at the periphery of valve stem 521, but it can also be located inside it. The configuration and material of power-receiving portion 521*c* is selected according to the connection method to power-feeding member 860, as described below. Power-receiving portion 521*c* can be positioned at a location farther from the valve head in the valve head than a fitting portion into the guide hole of the valve stem. One end of electromagnetic wave transmission line 830 is connected to antenna 820. The other end, which is covered with an insulator or dielectric, extends to power-receiving portion 521*c* at a fitting portion into the guide hole 340 of valve stem 521 and connects to it. Electromagnetic wave transmission line 830 runs inside basic portion 521*a* of valve stem 521. Therefore the other end of electromagnetic wave transmission line 830 is covered with a dielectric and extends to power-receiving portion 521*c*. Whereas basic portion 521*a* is made from dielectric, the other end of the electromagnetic wave transmission line is covered with an insulator and extends to power-receiving portion. Thus, when electromagnetic waves are supplied between power-receiving portion 521*c* and the earth member such as cylinder head 300, they are introduced into antenna 820.

Electromagnetic wave generator 840, which supplies electromagnetic waves to power-receiving portion 521*c*, is installed in internal combustion engine E or its surroundings. Electromagnetic wave generator 840 generates electromagnetic waves. In this embodiment of electromagnetic wave generator 840 is a magnetron that generates 2.4-GHz-bandwidth microwaves. However, this does not restrict interpretation of composition of electromagnetic wave generator of the plasma apparatus of the present invention.

Power-receiving portion 521*c* is exposed on the outer surface of valve stem 521 in exhaust valve 520, as shown in FIGS. 2 and 3. Dielectric member 850 and power-feeding member 860 are in Cylinder head 300. Dielectric member 850 is made from a ceramic and approaches power-receiving portion 521*c* at least when valve head 522 of exhaust valve 520 closes the exhaust port opening 321 in the side of the combustion chamber. Dielectric member 850 must be made from a dielectric. Power-feeding member 860 is made from metal. Power-feeding member 860 is close to the dielectric member 850 opposite the valve stem of exhaust valve 520. Power-feeding member 860 must be made from conductive material. The electromagnetic wave transmission method between power-feeding member 860 and power-receiving portion 521*c* via dielectric member 850 can be either electric coupling (capacitive) or magnetic coupling (dielectric). The configuration and material of power-feeding member 860 and power-receiving portion 521*c* may be selected according to the method. For example, in the case of electric coupling, power-feeding member 860 and power-receiving portion 521*c* should be conductive plates facing each other. The power feeding member 860 and the power receiving portion 521*c* may be respectively electric antenna with predefined advantage to electromagnetic waves generated by the electromagnetic wave generator 840. In the case of magnetic coupling, power-feeding member 860 and power-receiving portion 521*c* should be conductive coils. The power feeding member 860 and the power receiving portion 521*c* may be respectively a magnetic antenna with predefined advantage to electromagnetic waves generated by the electromagnetic wave generator 840. As a result, the electromagnetic wave generator 840 provides the power feeding member 860 with electromagnetic waves when the power feeding member 860 receives an output signal of the electromagnetic wave generator 840.

As shown in FIG. 2, valve guide mounted hole 350, which penetrates from the exhaust port 320 to the outer wall of cylinder head 300, is installed in the cylinder head 300. Valve guide with trunk shape made from a ceramics fits into the valve guide mounted hole 350, allowing a hole in the valve guide 360 to serve as a guide hole 340. Valve guide may be made from dielectric material. In valve guide 360, a portion approaching the power-receiving portion 521*c* at least when the valve head 522 of the exhaust valve 520 closes the combustion chamber side opening of the exhaust port 320 is the dielectric member 850.

And at the compression stroke when said valve head 522 closes the combustion chamber side opening 321 of said exhaust port 320, a discharge is generated between first electrode 812 and second electrode 813, and electromagnetic waves fed from the electromagnetic wave generator 840 through the electromagnetic wave transmission line 830 are radiated from the antenna 820. Cylinder block 100 or cylinder head 300 are earthed. The earth terminals of discharge voltage generator 950 and electromagnetic wave generator 840 are earthed. Discharge voltage generator 950 and electromagnetic wave generator 840 are controlled by controller 880, which has a CPU, memory, and storage etc, and outputs control signals after computing input signals. Crank angle detection signals are sent from crank angle detector 890 to controller 880. Therefore, controller 880 receives signals from crank angle detector 890 and controls the actuations of discharge device 810 and electromagnetic wave generator 840. However, this does not restrict the control method and the composition of the input-output signals as for the plasma apparatus of the present invention.

At the compression stroke in the actuation of the internal combustion engine E, discharge is generated at the first electrode 812 and the second electrode 813 of the discharge device 810 and the electromagnetic waves fed from the electromagnetic wave generator 840 through the electromagnetic wave transmission line 830 are radiated from the antenna 820. Therefore, the plasma is generated near the first electrode 812 and second electrode 813. This plasma receives energy of an electromagnetic waves (electromagnetic wave pulse) supplied from the antenna 820 for a given period of time. As a result, the plasma generates a large amount of OH radicals and ozone to promote the combustion. In fact electrons near the first electrode 812 and the second electrode 813 are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the combustion of the mixture.

In this case, the cylinder block 100 etc. which are the major structural materials can be used without modification compared with existing internal combustion engine. Additionally, the exhaust valve 520, and the structure around this valve are remodeled. With the exception of internal combustion engine E which basically needs spark plug 810, it may mount a discharge device on the cylinder head in internal combustion engine E that is not necessary a spark plug 810. Therefore, it is realized to minimize the time required to design an internal combustion engine E and share many parts with existing internal combustion engines.

The configuration and structure of the antenna are not restricted for the plasma apparatus using a valve of the present invention. Even though there are various embodiments, said antenna 820 forms nearly a C shape to surround the center of the valve face 522*b* of the valve head 522 as for the plasma apparatus in the first embodiment. One end of antenna 820 is connected to electromagnetic wave transmission line 830. This makes the antenna 820 compact on the valve face 522*b*.

The structure for transmitting electromagnetic waves from the electromagnetic wave generator to the electromagnetic wave transmission line is not restricted for the plasma apparatus using a valve of the present invention. In the first embodiment of the plasma apparatus, power-receiving portion 521*c* is exposed on the outer surface of valve stem 521 of exhaust valve 520 among such varied embodiments. The plasma apparatus has dielectric member 850 and power-feeding member 860. Dielectric member 850 is installed in cylinder head 300 and approaches power-receiving portion 521*c* at least when valve head 522 of exhaust valve 520 closes the exhaust port 320 opening in the side of combustion chamber. Dielectric member 850 is made from dielectric material. Power-feeding member 860 is installed in cylinder head 300. Power-feeding member 860 is close to the dielectric member 850 opposite the valve stem 521. Power-feeding member 860 is made from conductive material. Power-feeding member 860 is fed electromagnetic waves from electromagnetic wave generator 840. This makes it possible to have non-contact electromagnetic wave transmission from electromagnetic wave generator 840 to electromagnetic wave transmission line 830 through power-feeding member 860, dielectric member 850, and power-receiving portion 521*c*.

The structure near the guide hole is not restricted for the plasma apparatus using a valve of the present invention. In the first embodiment of the plasma apparatus, a valve guide mounted hole 350, which penetrates from the exhaust port 320 to the outer wall of cylinder head 300, is installed in the cylinder head 300 among such varied embodiments. A valve guide 360 with trunk shape, made from dielectric material, fits into the valve guide mounted hole 350 allowing a hole in the valve guide 360 to serve as a guide hole. A portion of the valve guide 360, approaching the power-receiving portion 521*c* at least when the valve head 522 closes the combustion chamber side opening of the exhaust port 320, is the dielectric member. This makes it possible to have non-contact electromagnetic wave transmission from electromagnetic wave generator 840 to electromagnetic wave transmission line 830 by using heretofore known mechanism for mounting the valve guide.

The positional relationship between the antenna and the electrode is not restricted for the plasma apparatus using a valve of the present invention. In the first embodiment of the plasma apparatus using a valve, first electrode 812 and second electrode 813 are located close to a portion where the electric field intensity generated by the electromagnetic waves around the valve face 522*b* of the valve head 522 becomes strong when the electromagnetic waves are fed to the antenna 820. This makes it possible that the electromagnetic wave pulse irradiates the plasma generated by the discharge at first electrode 812 and second electrode 813 from the antenna near plasma. The energy is intensively supplied to said plasma. As a result, a large amount of OH radicals and ozone is efficiently generated, further promoting the combustion.

Figure 5:
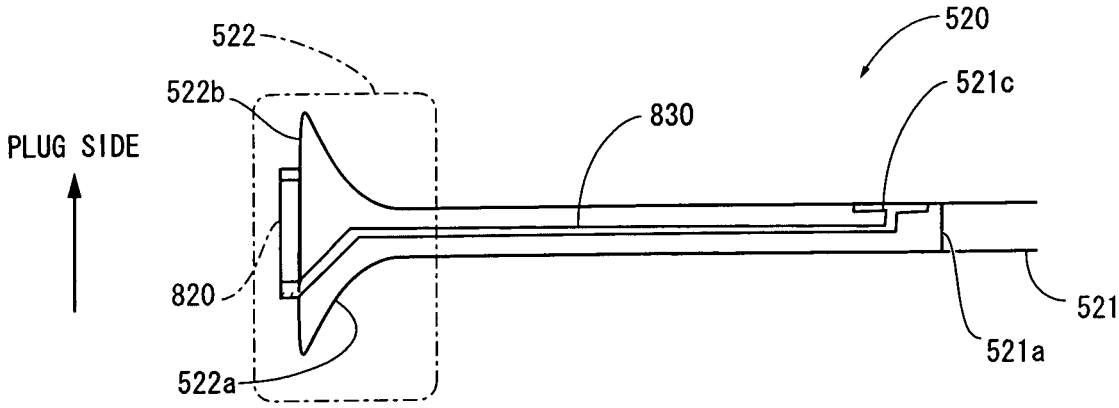
FIG. 5 shows an enlarged vertical cross-sectional view of exhaust valve used in the plasma apparatus using a valve in the second embodiment of the present invention.

Next, the second embodiment of the plasma apparatus using a valve of the present invention will be described. This plasma apparatus using a valve differs from the first embodiment only in the composition of exhaust valve 520. In the exhaust valve 520 of the plasma apparatus in the first embodiment, the interior of valve stem 521 that fits into guide hole 340 is made from a dielectric or insulator as a basic portion 521*a*. Moreover, a fitting portion into the guide hole 340 on the periphery of the basic portion 521*a* is made from metal as a periphery portion 521*b*. In the exhaust valve 520 of the plasma apparatus in the second embodiment, not only basic portion 521*a* but periphery portion 521*b* are an integral structure and are made from a dielectric or insulator, as shown in FIG. 5. This increases the relative volume of the dielectric or insulator for the same valve stem 521 diameter. Thus, if the impedance of electromagnetic wave transmission line 830 is same level between the first and second embodiments, the cross-sectional area of electromagnetic wave transmission line 830 for the second embodiment will be larger, increasing the transmitting efficiency. Other functions and effects are similar to the first embodiment of the plasma apparatus.

In the plasma apparatus using a valve of the present invention, a pair of the electrodes or a pair of the electrode and the earth member may as well be covered with a dielectric. In this case, the dielectric-barrier discharge is generated by voltage applied between the electrodes or between the electrode and the earth member. The dielectric-barrier discharge is restricted because charges are accumulated in the surface of the dielectric covering the electrode or the earth member. Therefore, the discharge is generated on a very small scale over a very short period of time. Thermalization does not occur in the area surrounding the discharge because the discharge is terminated after a short period of time. Therefore, the gas temperature rise due to the discharge between the electrodes is reduced, which reduces the amount of NOx produced by the internal combustion engine.

In the embodiment mentioned above, the plasma apparatus is composed by using the exhaust valve. That is, these plasma apparatus has the antenna 820 arranged on the valve face 522*b* of the valve head 522 of the exhaust valve 520. The electromagnetic wave transmission line 830 is installed in the valve stem 521 of the exhaust valve 520. The electromagnetic wave generator 840 for feeding electromagnetic waves is in the power-receiving portion 521*c* which is arranged on the valve stem 521 of the exhaust valve 520. At compression stroke when the valve head 522 of the exhaust valve 520 closes the combustion chamber side opening 321 of the exhaust port 320, this plasma apparatus configures that discharge is generated between the electrodes of the discharge device 810, and electromagnetic waves fed from the electromagnetic wave generator 840 through the electromagnetic wave transmission line 830 is radiated from the antenna 820. But the present invention includes an embodiment which the plasma apparatus is composed by using an intake valve. That is, the plasma apparatus using an intake valve has an antenna arranged on the valve face of the valve head of the intake valve. An electromagnetic wave transmission line is installed in the valve stem of the intake valve. The electromagnetic wave generator for feeding electromagnetic waves is installed in the power-receiving portion which is arranged on the valve stem of the intake valve. At the compression stroke when the valve head of the intake valve closes the combustion chamber side opening of said intake port, this plasma apparatus configures that discharge is generated between the electrodes of the discharge device 810, and electromagnetic waves fed from the electromagnetic wave generator through the electromagnetic wave transmission line 830 is radiated from the antenna 820. In this case, the component of the intake valve, the antenna, the electromagnetic wave line, the power-receiving portion, the electromagnetic wave generator, the discharge device, and the electrodes of the discharge device is similar to the exhaust valve etc. of the plasma apparatus using the exhaust valve. Functions and effects of the plasma apparatus using the intake valve are similar to the case of said each embodiment. The antenna forms nearly a C-shaped to surround the center of the valve face. Functions and effects, in the case that one end of this antenna is connected to electromagnetic wave transmission line, are similar to the case of said each embodiment. The power-receiving portion is exposed on outer surface of said valve stem. The dielectric member is installed in said cylinder head, and gets close to said power-receiving portion, at least when said valve head closes the combustion chamber side opening of the intake port. The dielectric member is made from dielectric. The power-feeding member is installed in the cylinder head. The power-feeding member, made from conductive, gets close to the dielectric member from the opposite side of the valve stem. Functions and effects are similar to the case of said each embodiment in the case that electromagnetic waves are supplied from the electromagnetic wave generator to the power-receiving portion. In addition, a valve guide mounted hole, which penetrates from the intake port to the outer wall of the cylinder head, in installed in the cylinder head. The valve guide with trunk shape made from a ceramics fits into the valve guide mounted hole, allowing a hole in the valve guide 360 to serve as a guide hole 340. Functions and effects are similar to the case of said each embodiment in the case that a portion of the valve guide, approaching said power-receiving portion at least when said valve head closes the combustion chamber side opening of the intake port, is the dielectric member. Moreover, Functions and effects are similar to the case of said each embodiment in the case that the electrodes are located close to a portion that electric field intensity, generated by the electromagnetic waves in the antenna, becomes strong when the electromagnetic waves are fed to said antenna.

The present invention includes some embodiments that combine the characteristics of the embodiments described above. Moreover, the embodiments described above are only examples of the plasma apparatus using a valve of the present invention. Thus, the description of these embodiments does not restrict interpretation of the plasma apparatus using a valve of the present invention.

The invention claimed is:

1. A plasma apparatus using a valve, which is installed in an internal combustion engine in which the combustion chamber side opening of an intake port or an exhaust port is opened and closed at a given timing with a valve head at the end of a valve stem of an intake valve or an exhaust valve, the intake port is formed in a cylinder head and connects to the combustion chamber to be part of an intake passage, the exhaust port is formed in the cylinder head and connects to the combustion chamber to be part of an exhaust passage, a guide hole is formed in the cylinder head and the valve stem fits into the guide hole penetrating from the intake port or the exhaust port to the outer wall of the cylinder head and reciprocating freely, the plasma apparatus comprising:

a discharge device with an electrode exposed to the combustion chamber installed in the cylinder head;

an antenna installed on the valve face of the valve head;

an electromagnetic wave transmission line installed in the valve stem with one end connected to the antenna and the other end, covered with an insulator or dielectric and extending to a power-receiving portion, which is positioned at a location fitting into the guide hole or at a location farther from the valve head in the valve stem; and an electromagnetic wave generator for feeding electromagnetic waves to the power-receiving portion;

wherein the plasma apparatus is configured such that discharge is generated with the electrode of the discharge device and the electromagnetic waves fed from the electromagnetic wave generator through the electromagnetic wave transmission line are radiated from the antenna at the compression stroke when the combustion chamber side opening of the intake port or the exhaust port is closed with the valve head.

2. The plasma apparatus according to claim 1, wherein the antenna forms nearly a C shape to surround the center of the valve face and one end of the antenna is connected to the electromagnetic wave transmission line.

3. The plasma apparatus according to claim 1, wherein the power-receiving portion exposed on the outer wall of valve stem, and the plasma apparatus includes:

a dielectric member installed in the cylinder head and near the power-receiving portion, at least when the valve head closes the combustion chamber side opening of the intake port or the exhaust port, made from dielectric material; and a power-feeding member made from conductive material, which is installed in the cylinder head close to the dielectric member opposite the valve stem;

wherein plasma apparatus is configured such that the power-feeding member would be fed the electromagnetic waves from the electromagnetic wave generator.

4. The plasma apparatus according to claim 1, wherein a valve guide mounted hole, which penetrates from the intake port or the exhaust port to the outer wall of cylinder head, is installed in the cylinder head, a valve guide having a trunk shape is made from dielectric material and fits into the valve guide mounted hole allowing a hole in the valve guide to serve as the guide hole for the valve stem, and a portion of the valve guide, approaching the power-receiving portion at least when the valve head closes the combustion chamber side opening of the intake port or the exhaust port, is the dielectric member.

5. The plasma apparatus according to claim 1, wherein the electrode is located close to a portion where the electric field intensity generated by the electromagnetic waves around the valve face of the valve head becomes strong when the electromagnetic waves are fed to the antenna.

6. The plasma apparatus according to claim 2, wherein the power-receiving portion exposed on the outer wall of valve stem, and the plasma apparatus includes:

a dielectric member installed in the cylinder head and near the power-receiving portion, at least when the valve head closes the combustion chamber side opening of the intake port or the exhaust port, made from dielectric material; and a power-feeding member made from conductive material, which is installed in the cylinder head close to the dielectric member opposite the valve stem;

wherein plasma apparatus is configured such that the power-feeding member would be fed the electromagnetic waves from the electromagnetic wave generator.

7. The plasma apparatus according to claim 2, wherein a valve guide mounted hole, which penetrates from the intake port or the exhaust port to the outer wall of cylinder head, is installed in the cylinder head, a valve guide having a trunk shape is made from dielectric material and fits into the valve guide mounted hole allowing a hole in the valve guide to serve as the guide hole for the valve stem, and a portion of the valve guide, approaching the power-receiving portion at least when the valve head closes the combustion chamber side opening of the intake port or the exhaust port, is the dielectric member.

8. The plasma apparatus according to claim 3, wherein a valve guide mounted hole, which penetrates from the intake port or the exhaust port to the outer wall of cylinder head, is installed in the cylinder head, a valve guide having a trunk shape is made from dielectric material and fits into the valve guide mounted hole allowing a hole in the valve guide to serve as the guide hole for the valve stem, and a portion of the valve guide, approaching the power-receiving portion at least when the valve head closes the combustion chamber side opening of the intake port or the exhaust port, is the dielectric member.

9. The plasma apparatus according to claim 2, wherein the electrode is located close to a portion where the electric field intensity generated by the electromagnetic waves around the valve face of the valve head becomes strong when the electromagnetic waves are fed to the antenna.

10. The plasma apparatus according to claim 3, wherein the electrode is located close to a portion where the electric field intensity generated by the electromagnetic waves around the valve face of the valve head becomes strong when the electromagnetic waves are fed to the antenna.

11. The plasma apparatus according to claim 4, wherein the electrode is located close to a portion where the electric field intensity generated by the electromagnetic waves around the valve face of the valve head becomes strong when the electromagnetic waves are fed to the antenna.

* * * * *